US008933847B2

(12) United States Patent
Yang et al.

(10) Patent No.: US 8,933,847 B2
(45) Date of Patent: Jan. 13, 2015

(54) MOBILE WIRELESS COMMUNICATIONS DEVICE HAVING ANTENNA ASSEMBLY WITH ELECTRICALLY CONDUCTIVE BASE ENCLOSING AN ELONGATE SLOT AND ASSOCIATED METHODS

(75) Inventors: Shing Lung Steven Yang, San Diego, CA (US); Firass Mirza Badaruzzaman, Forest Park, IL (US); David Kazmierz Szczypinski, Elgin, IL (US)

(73) Assignee: BlackBerry Limited, Waterloo, Ontario (CA)

( * ) Notice: Subject to any disclaimer, the term of this patent is extended or adjusted under 35 U.S.C. 154(b) by 201 days.

(21) Appl. No.: 13/439,924

(22) Filed: Apr. 5, 2012

(65) Prior Publication Data

US 2012/0280868 A1 Nov. 8, 2012

Related U.S. Application Data

(60) Provisional application No. 61/472,289, filed on Apr. 6, 2011.

(51) Int. Cl.
*H01Q 1/24* (2006.01)
*H01Q 9/04* (2006.01)

(52) U.S. Cl.
CPC ..... *H01Q 9/0421* (2013.01); *H01Q 1/243* (2013.01)
USPC ..... 343/702; 343/700 MS

(58) Field of Classification Search
CPC ..... H01Q 1/38; H01Q 1/243; H01Q 9/0421
USPC ..... 343/702, 700 MS, 846
See application file for complete search history.

(56) References Cited

U.S. PATENT DOCUMENTS

| | | | | |
|---|---|---|---|---|
| 4,692,769 | A | 9/1987 | Gegan | |
| 6,515,630 | B2 * | 2/2003 | Honda | 343/702 |
| 6,741,214 | B1 * | 5/2004 | Kadambi et al. | 343/700 MS |

(Continued)

FOREIGN PATENT DOCUMENTS

| | | |
|---|---|---|
| EP | 1024552 | 8/2000 |
| WO | 0108257 | 2/2001 |

OTHER PUBLICATIONS

Sittironnarit et al., "A Dual-Band Vehicular Planar Inverted-F Antenna for Ultra High Frequency (UHF) Applications", IEEE 55th Vehicular Technology Conference, vol. 1, No., May 2002, pp. 345-349.

*Primary Examiner* — Hoanganh Le
(74) *Attorney, Agent, or Firm* — Allen, Dyer, Doppelt, Milbrath & Gilchrist, P.A.

(57) ABSTRACT

A mobile wireless communications device may include a housing carrying a circuit board and wireless communications circuitry. An antenna assembly is carried by the housing and coupled to the wireless communications circuitry. The antenna assembly may include an electrically conductive base having a rectangular shape with opposing first and second ends and opposing first and second sides extending between the first and second ends. The electrically conductive base may have an elongate slot therein extending within a medial portion thereof and contained within the opposing first and second ends and the opposing first and second sides. The antenna assembly also may include an electrically conductive feed arm extending outwardly from the first side of the electrically conductive base adjacent the first end thereof. The electrically conductive feed arm may have a distal end with an antenna feed defined thereon.

20 Claims, 8 Drawing Sheets

(56) References Cited

U.S. PATENT DOCUMENTS

| | | | | |
|---|---|---|---|---|
| 6,831,607 | B2 * | 12/2004 | Hebron et al. | 343/700 MS |
| 6,850,192 | B2 | 2/2005 | Yeh | |
| 7,023,386 | B2 | 4/2006 | Habib et al. | |
| 7,612,734 | B2 | 11/2009 | Tsai et al. | |
| 7,671,804 | B2 * | 3/2010 | Zhang et al. | 343/700 MS |
| 7,808,438 | B2 | 10/2010 | Schlub et al. | |
| 7,859,480 | B2 | 12/2010 | Shimizu | |
| 8,587,481 | B2 * | 11/2013 | Lai et al. | 343/700 MS |
| 2003/0122722 | A1 * | 7/2003 | Sugiyama et al. | 343/767 |
| 2007/0040745 | A1 | 2/2007 | Chen et al. | |
| 2007/0085747 | A1 * | 4/2007 | DiNallo et al. | 343/702 |
| 2008/0055164 | A1 * | 3/2008 | Zhang et al. | 343/702 |
| 2008/0129637 | A1 | 6/2008 | Chi et al. | |
| 2009/0140942 | A1 * | 6/2009 | Mikkola et al. | 343/767 |
| 2011/0025567 | A1 * | 2/2011 | Qi et al. | 343/702 |

* cited by examiner

MOBILE WIRELESS COMMUNICATIONS DEVICE HAVING ANTENNA ASSEMBLY WITH ELECTRICALLY CONDUCTIVE BASE ENCLOSING AN ELONGATE SLOT AND ASSOCIATED METHODS

RELATED APPLICATION

This application is based upon prior filed copending provisional application Ser. No. 61/472,289 filed Apr. 6, 2011, the entire contents of which are incorporated herein by reference in their entirety.

TECHNICAL FIELD

The present disclosure generally relates to the field of wireless communications systems, and, more particularly, to mobile wireless communications devices and related methods.

BACKGROUND

Cellular communication systems continue to grow in popularity and have become an integral part of both personal and business communications. Cellular telephones allow users to place and receive phone calls almost anywhere they travel. Moreover, as cellular telephone technology is improved, so too has the functionality of cellular devices. For example, many cellular devices now incorporate Personal Digital Assistant (PDA) features such as calendars, address books, task lists, calculators, memo and writing programs, etc. These multi-function devices usually allow users to wirelessly send and receive electronic mail (email) messages and access the Internet via a cellular network and/or a wireless local area network (WLAN), for example.

As the functionality of cellular devices continues to increase, so too does demand for smaller devices that are easier and more convenient for users to carry. Nevertheless, the move towards multi-functional devices makes miniaturization more difficult as the requisite number of installed components increases. Indeed, the typical cellular device may include several antennas, for example, a cellular antenna, a global positioning system antenna, and a WiFi IEEE 802.11g antenna. These antennas may comprise external antennas and internal antennas.

Generally speaking, internal antennas allow cellular devices to have a smaller footprint. Moreover, they are also preferred over external antennas for mechanical and ergonomic reasons. Internal antennas are also protected by the cellular device's housing and therefore tend to be more durable than external antennas. External antennas may be cumbersome and may make the cellular device difficult to use, particularly in limited-space environments. Yet, one potential drawback of typical internal antennas is that they are in relatively close proximity to the user's head when the cellular device is in use, thereby increasing the specific absorption rate (SAR). Yet more, hearing aid compatibility (HAC) may also be affected negatively. Also, other components within the cellular device may cause interference with or may be interfered by the internal antenna.

DETAILED DESCRIPTION

Figure 1:
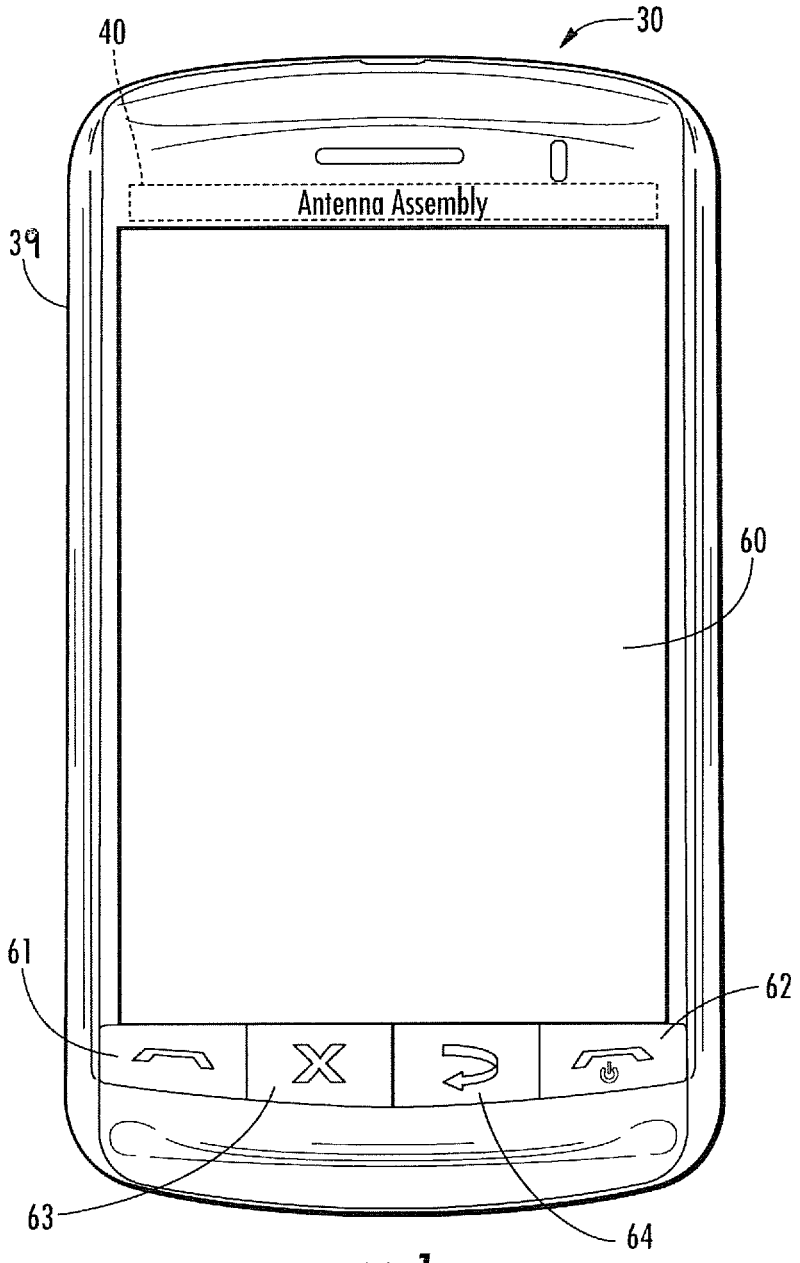
FIG. 1 is a top plan view of a mobile wireless communications device including an antenna assembly in accordance with one example embodiment.

The present description is made with reference to the accompanying drawings, in which various embodiments are shown. However, many different embodiments may be used, and thus the description should not be construed as limited to the embodiments set forth herein. Rather, these embodiments are provided so that this disclosure will be thorough and complete. Like numbers refer to like elements throughout.

Generally speaking, a mobile wireless communications device may include a housing, a circuit board carried by the housing, and wireless communications circuitry carried by the circuit board. The mobile wireless communications device may comprise an antenna assembly carried by the housing and coupled to the wireless communications circuitry. The antenna assembly may comprise an electrically conductive base having a rectangular shape with opposing first and second ends and opposing first and second sides extending between the first and second ends. The electrically conductive base may have an elongate slot therein extending within a medial portion thereof and contained within the opposing first and second ends and the opposing first and second sides. The antenna assembly may include an electrically conductive feed arm extending outwardly from the first side of the electrically conductive base adjacent the first end thereof, and having a distal end with at least one antenna feed defined thereon. This antenna assembly is compact and easy to manufacture, yet provides the mobile wireless communications device with good performance over a plurality of operating frequency bands.

In some applications, the antenna assembly may comprise a flexible substrate mounting the electrically conductive base and the electrically conductive feed arm. This flexible substrate may comprise a planar base mounting portion spaced from the circuit board and mounting the electrically conductive base, and an arm mounting portion extending downwardly from the planar base mounting portion and mounting the electrically conductive feed arm.

The elongate slot may have a variety of configurations. For example, the elongate slot may be longitudinally offset from the first end and toward the second end of the electrically conductive base. In addition, the elongate slot may be centered between the first and second sides of the electrically conductive base. Further, the elongate slot may have a rectangular shape. Moreover, the elongate slot may have a width less than a third of a width of the electrically conductive base. Also, the elongate slot may have a length greater than half a length of the electrically conductive base. The elongate slot may have a length greater than a corresponding length of the electrically conductive feed arm.

The at least one antenna feed may comprise first and second antenna feeds. In addition, the electrically conductive feed arm may have a slot therein extending through a medial portion between the first and second antenna feeds. Further, in some applications, the antenna assembly may be operable in a plurality of frequency bands.

Another aspect is directed to a method of making an antenna assembly for mobile wireless communications device comprising a housing, a circuit board carried by the housing, and wireless communications circuitry carried by the circuit board. The method may include forming an electrically conductive base having a rectangular shape with opposing first and second ends and opposing first and second sides extending between the first and second ends. The electrically conductive base may be formed to have an elongate slot therein extending within a medial portion thereof and contained within the opposing first and second ends and the opposing first and second sides. The method may also include forming an electrically conductive feed arm extending outwardly from the first side of the electrically conductive base adjacent the first end thereof, the electrically conductive feed arm being formed to have a distal end with at least one antenna feed defined thereon.

Figure 2:
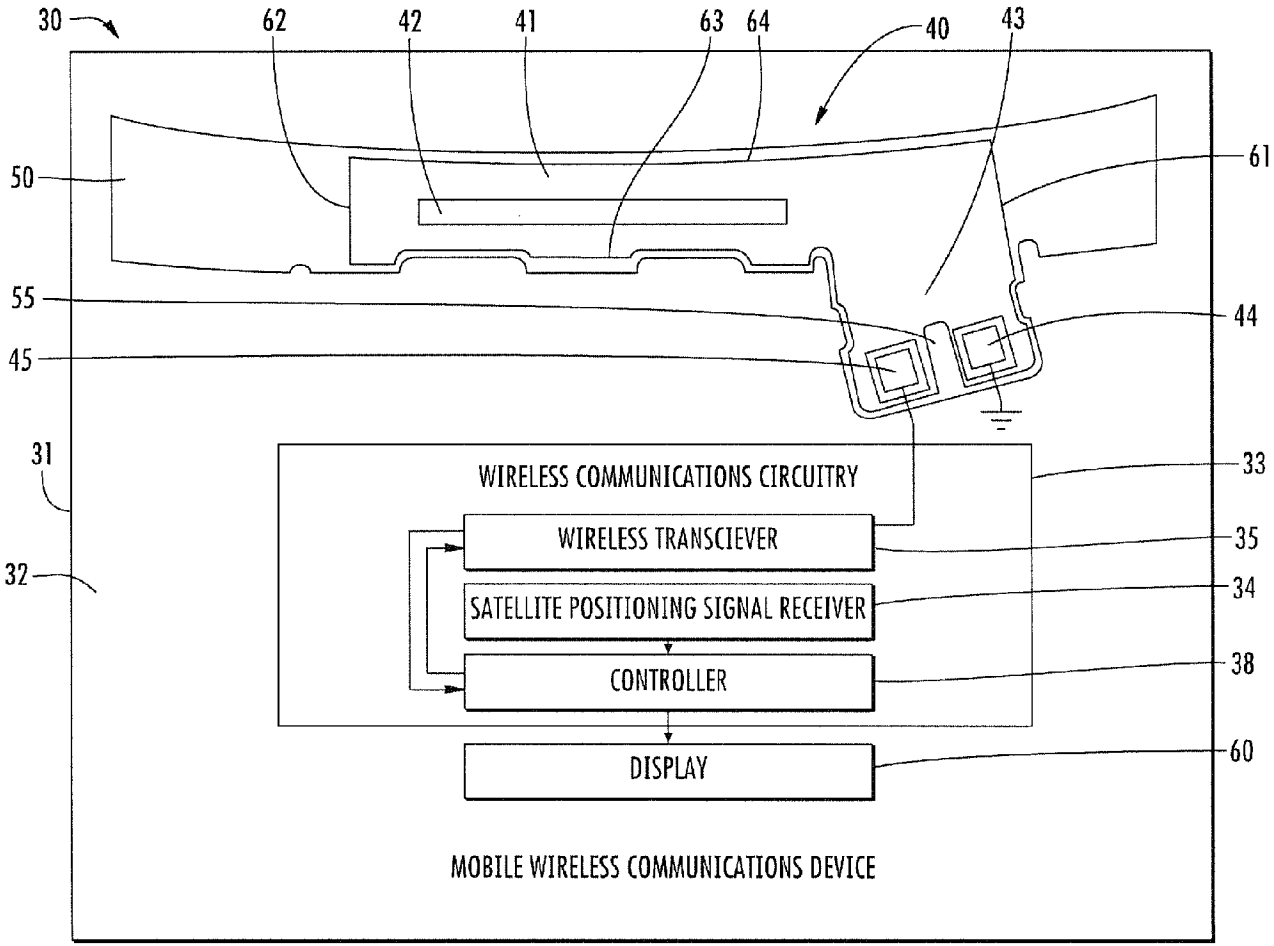
FIG. 2 is a schematic block diagram of the device of FIG. 1.
Figure 3:
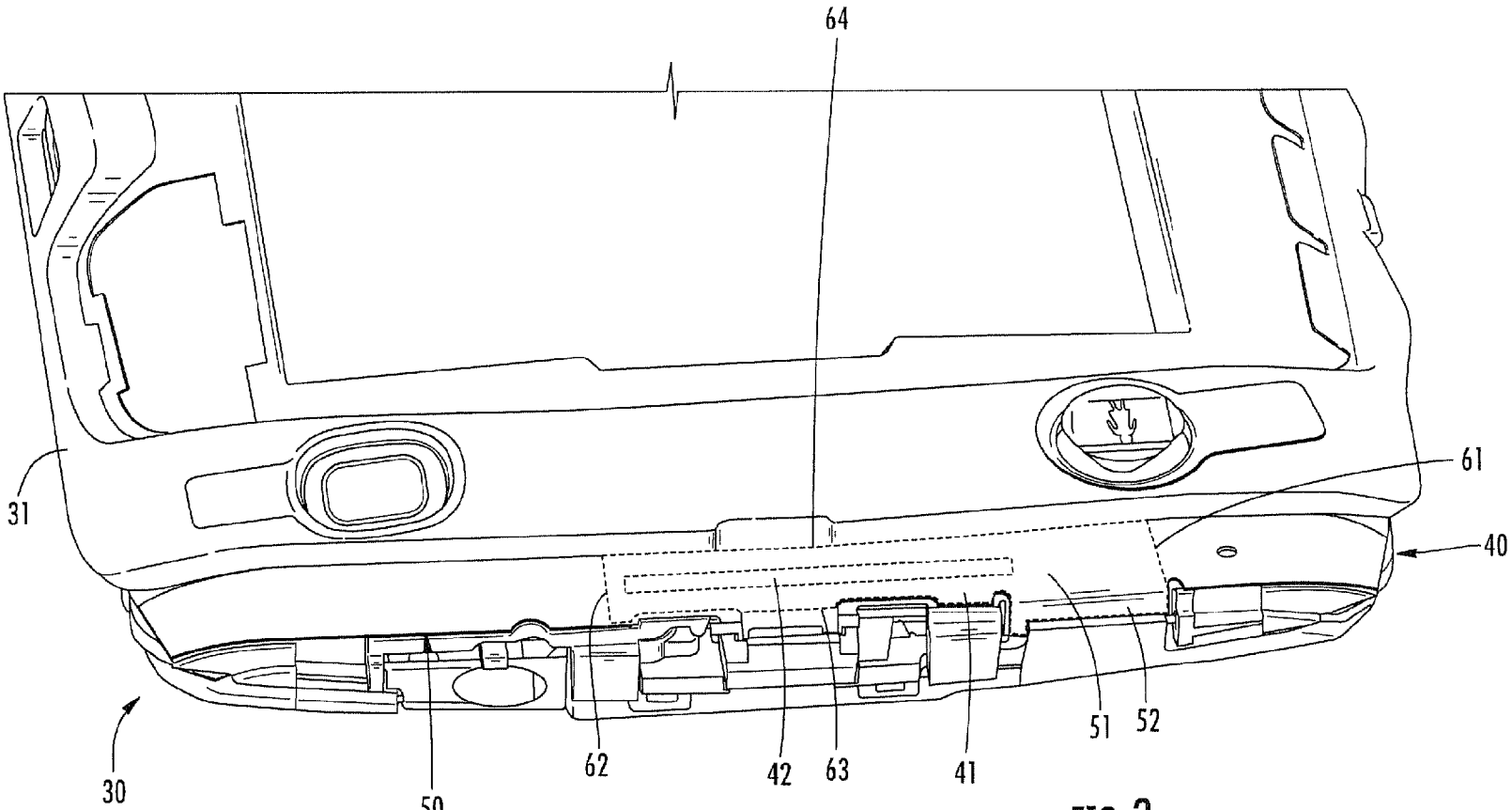
FIG. 3 is a perspective view of the antenna assembly installed in the mobile wireless communications device of FIG. 1.

Referring initially to FIGS. 1-3, a mobile wireless communications device 30 according to the present disclosure is now described. The mobile wireless communications device 30 illustratively includes a housing 39 and a substrate 32, for example, a printed circuit board (PCB) carried by the housing. The housing 39 has an upper portion and a lower portion. The substrate 32 may be a rigid PCB, or may be a flexible substrate or PCB, for example. In some embodiments wherein a PCB is used, the PCB may be replaced by or used in conjunction with a metal chassis or other substrate, as will be appreciated by those skilled in the art and described in further detail below. The substrate 32 may include a conductive layer defining the ground plane. The substrate 32 may also include a dielectric layer carrying the conductive layer. The substrate 32 may have additional layers, as will be appreciated by those skilled in the art.

The mobile wireless communications device 30 includes wireless communications circuitry 33 carried by the housing 39. The wireless communications circuitry 33 may include, for example, a wireless transceiver 35. The wireless transceiver 35 may be a WiFi (IEEE 802.11) transceiver or a cellular transceiver, for example. The wireless communications circuitry 33 may also include, in some embodiments, a satellite positioning signal receiver 34. The satellite positioning signal receiver 34 may be a Global Positioning System (GPS) satellite receiver, for example. Of course, the mobile wireless communications device 30 may not include a satellite positioning receiver, or may include additional receivers and/or transmitters, for example, near-field communications (NFC) receivers and/or transmitters and wireless local area network receivers (e.g. 802.xx, WiFi, WiMax). Thus, the satellite positioning receiver 34 or additional receivers and/or transmitters may not be part of the wireless communications circuitry 33, as will be appreciated by those skilled in the art.

The mobile wireless communications device 30 further illustratively includes a display 60 and a plurality of control keys including an "off hook" (i.e., initiate phone call) key 61, an "on hook" (i.e., discontinue phone call) key 62, a menu key 63, and a return or escape key 64. Operation of the various device components and input keys, etc., will be described further below with reference to FIG. 4.

The wireless communications circuitry 33 may also include a controller 38 or processor. The controller 38 may cooperate with the other components, for example, the antenna assembly 40, the satellite positioning signal receiver 34, and the wireless transceiver 33 to coordinate and control operations of the mobile wireless communications device 30. Operations may include mobile voice and data operations, including email and Internet data.

The antenna assembly 40 comprises a flexible substrate 50. An electrically conductive base 41 is mounted on the flexible substrate 50, for example, being a pattern of conductive traces thereon. The electrically conductive base 41 has a rectangular shape with opposing first and second ends 61-62 and opposing first and second sides 63-64 extending between the first and second ends in the illustrated embodiment. The first and second sides 63-64 have a length that is greater than the length of the first and second ends 61-62. An elongate slot 42 is defined in a medial portion of the electrically conductive base 41, and is contained within the opposing first and second ends 61-62 and the opposing first and second sides 63-64 in the illustrated embodiment.

The antenna assembly 40 includes an electrically conductive feed arm 43 extending outwardly from the first side 63 of the electrically conductive base 41 adjacent the first end 61 thereof and has a distal end with a first antenna feed 45 defined thereon. A second antenna feed 44 in the form of an antenna ground is also defined on the distal end of the electrically conductive feed arm 43. The first antenna feed 45 is coupled to the wireless transceiver 35, while the second antenna feed 44 is coupled to ground. An elongate slot extends through a medial portion of the electrically conductive feed arm 43 between the first and second antenna feeds 45, 44.

This antenna assembly 40 advantageously allows operation in multiple bands. For example, the electrically conductive base 41 resonates at a first frequency, such as 1.57 GHz, whereas the edges of the electrically conductive base that define the elongate slot 42 resonate at a second frequency that may be greater than the first frequency, such as 2.4 GHz.

The elongate slot 42 is illustratively longitudinally offset from the first end 61 and toward the second end 62 of the electrically conductive base 41. In addition, the elongate slot 42 is illustratively centered between the first and second sides of the electrically conductive base 41. Further, the elongate slot 42 illustratively has a rectangular shape, with a width of less than a third of a width of the electrically conductive base 41, and a length greater than half a length of the electrically conductive base. In addition, it should be noted that the elongate slot 42 illustratively has a length greater than a corresponding length of the electrically conductive feed arm 43.

Figure 4:
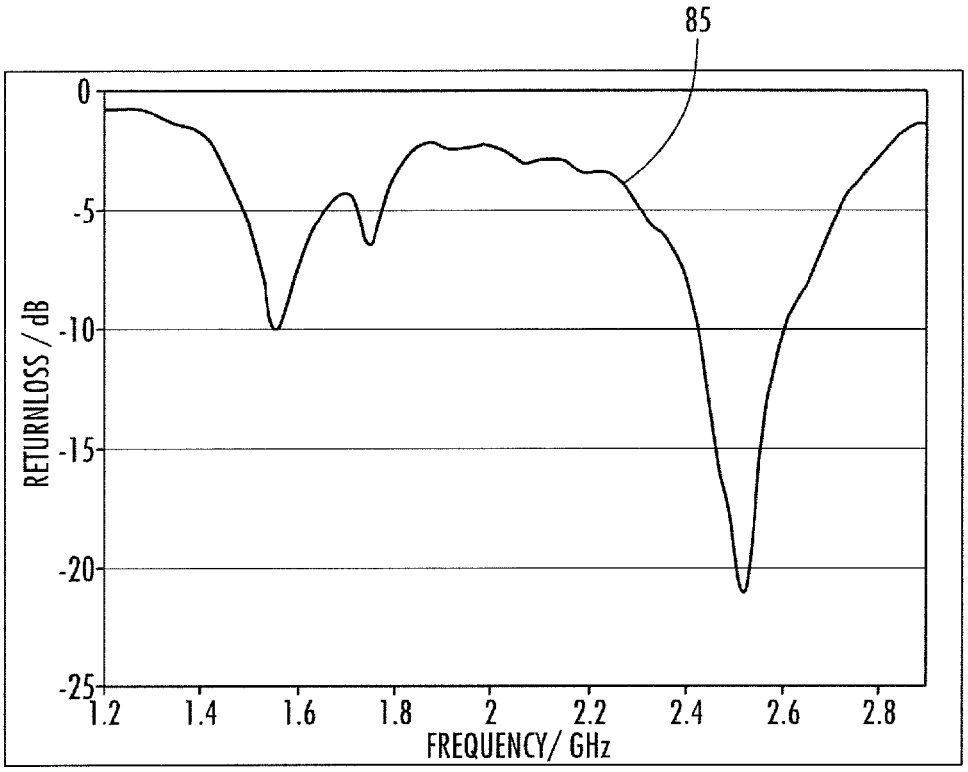
FIG. 4 is an S-parameter plot of the antenna assembly of FIG. 2.
Figure 5:
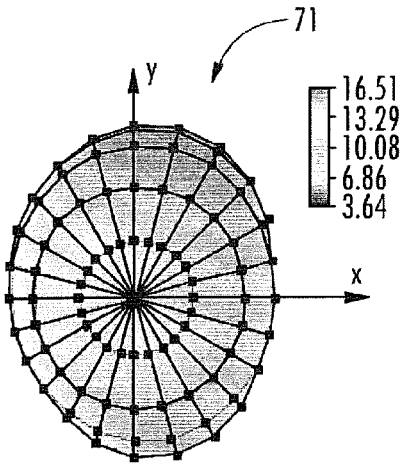
FIG. 5 is a first side of a two dimensional radiation pattern of the antenna assembly of FIG. 2 along the X-Y axis while radiating at a first frequency.
Figure 6:
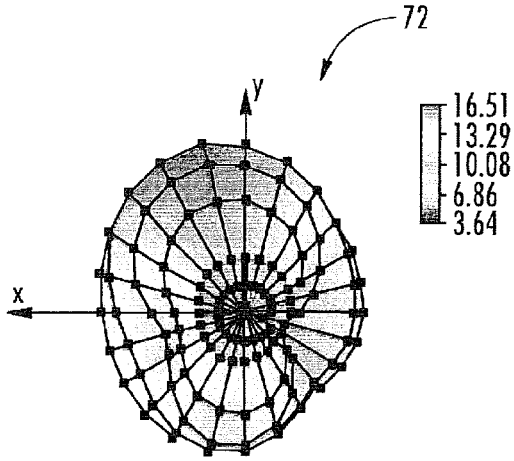
FIG. 6 is a second side of a two dimensional radiation pattern of the antenna assembly of FIG. 2 along the X-Y axis while radiating at a first frequency.
Figure 7:
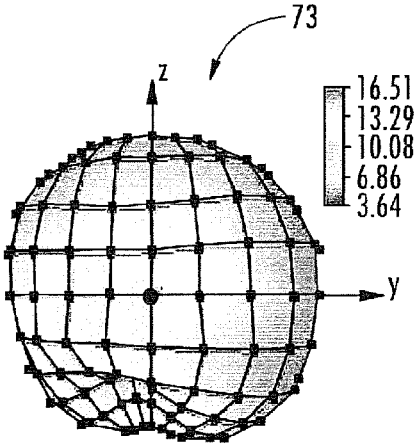
FIG. 7 is a first side of a two dimensional radiation pattern of the antenna assembly of FIG. 2 along the Y-Z axis while radiating at a first frequency.
Figure 8:
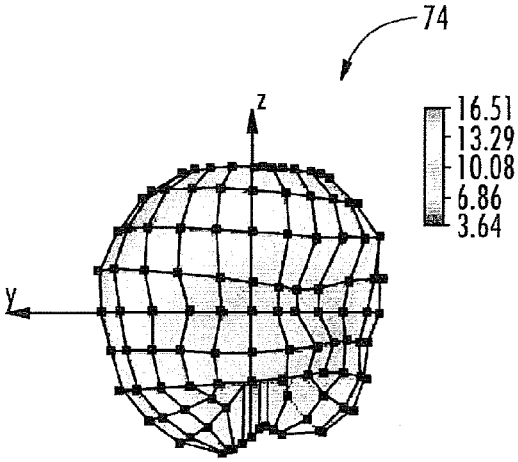
FIG. 8 is a second side of a two dimensional radiation pattern of the antenna assembly of FIG. 2 along the Y-Z axis while radiating at a first frequency.
Figure 9:
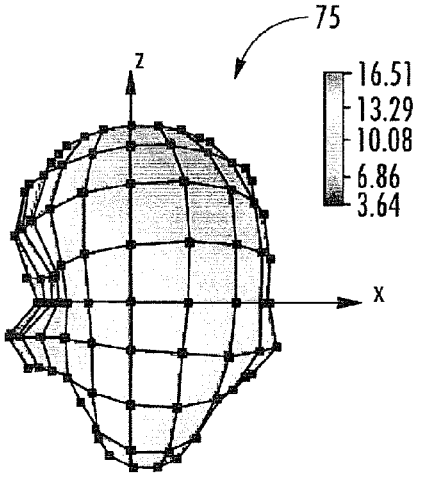
FIG. 9 is a first side of a two dimensional radiation pattern of the antenna assembly of FIG. 2 along the X-Z axis while radiating at a first frequency.
Figure 10:
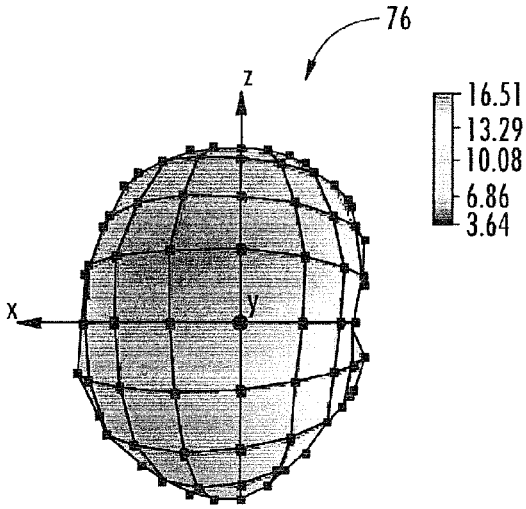
FIG. 10 is a second side of a two dimensional radiation pattern of the antenna assembly of FIG. 2 along the X-Z axis while radiating at a first frequency.
Figure 11:
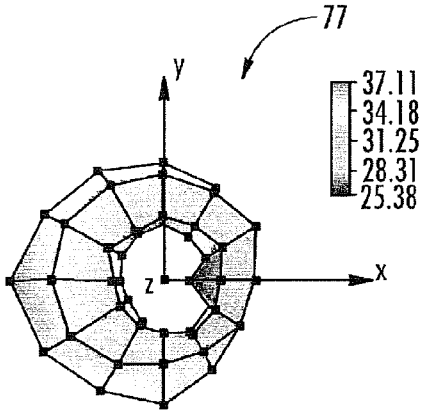
FIG. 11 is a first side of a two dimensional radiation pattern of the antenna assembly of FIG. 2 along the X-Y axis while radiating at a second frequency.
Figure 12:
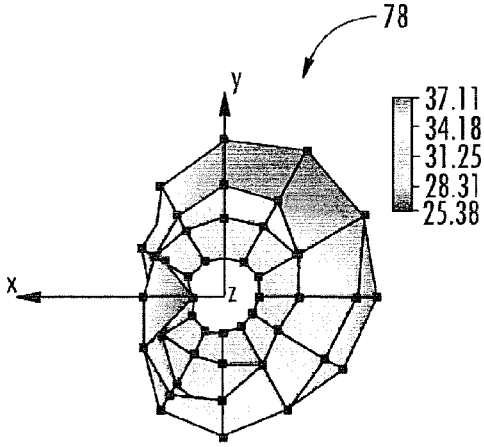
FIG. 12 is a second side of a two dimensional radiation pattern of the antenna assembly of FIG. 2 along the X-Y axis while radiating at a second frequency.
Figure 13:
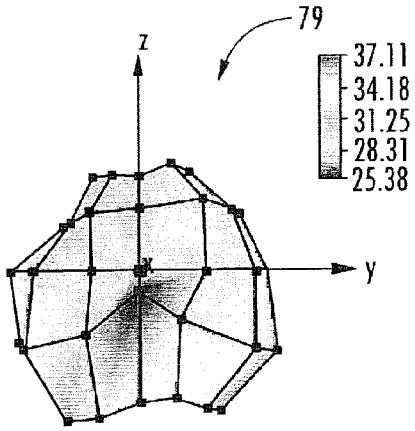
FIG. 13 is a first side of a two dimensional radiation pattern of the antenna assembly of FIG. 2 along the Y-Z axis while radiating at a second frequency.
Figure 14:
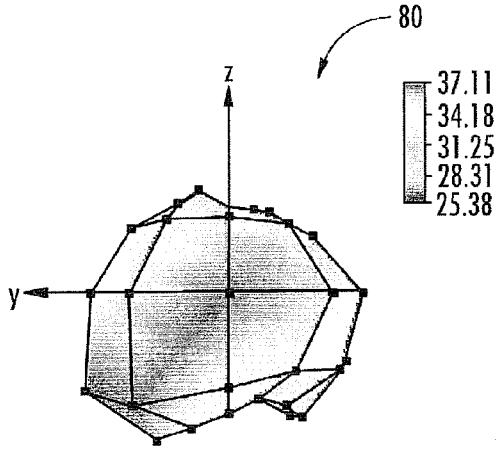
FIG. 14 is a second side of a two dimensional radiation pattern of the antenna assembly of FIG. 2 along the Y-Z axis while radiating at a second frequency.
Figure 15:
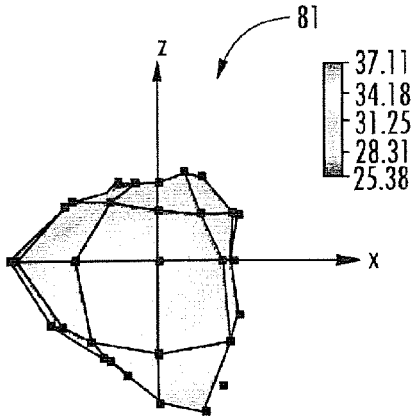
FIG. 15 is a first side of a two dimensional radiation pattern of the antenna assembly of FIG. 2 along the X-Z axis while radiating at a second frequency.
Figure 16:
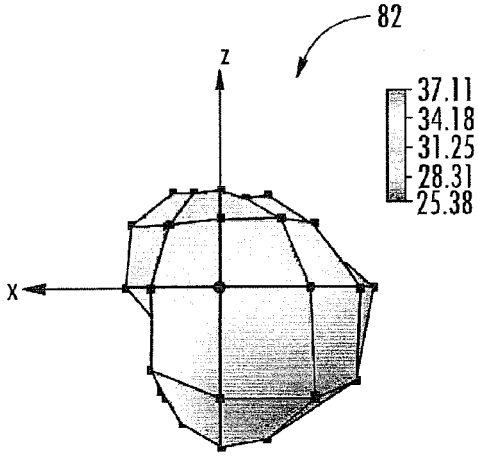
FIG. 16 is a second side of a two dimensional radiation pattern of the antenna assembly of FIG. 2 along the X-Z axis while radiating at a second frequency.

An S-parameter plot 71 of the antenna assembly 40 while radiating is shown in FIG. 4. Two dimensional radiation patterns 72-76 of the antenna assembly 40 while radiating at a first frequency are shown in FIGS. 5-10. In addition, two dimensional radiation patterns 77-82 of the assembly 40 while radiating at a second frequency are shown in FIGS. 11-16.

With reference to FIG. 3, the flexible substrate 50 includes a planar base mounting portion 51 spaced from the circuit board 31 and mounting the electrically conductive base 41 (shown with dashed lines), and an arm mounting portion 52 extending downwardly from the planar base mounting portion and mounting the electrically conductive feed arm 43. The arm mounting portion 53 may be folded such that the feed point 45 and ground point 44 couple with the circuit board 31.

The present disclosure includes methods of making antenna assembly 40 for use in mobile wireless communications device 30. The method includes forming an electrically conductive base 41 having a rectangular shape with opposing first and second ends 61-62 and opposing first and second sides 63-64 extending between the first and second ends. The electrically conductive base 41 is formed to have an elongate slot 42 therein extending within a medial portion thereof and contained within the opposing first and second ends 61-62 and the opposing first and second sides 63-64. The method also includes forming an electrically conductive feed arm 43 extending outwardly from the first side 63 of the electrically conductive base 41 adjacent the first end 61 thereof. The electrically conductive feed arm 43 is formed to have a distal end with at least one antenna feed 45 defined thereon.

Example components of a mobile wireless communications device 1000 that may be used in accordance with the above-described embodiments are further described below with reference to FIG. 17. The device 1000 illustratively includes a housing 1200, a keyboard or keypad 1400 and an output device 1600. The output device shown is a display 1600, which may comprise a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400.

The housing 1200 may be elongated vertically, or may take on other sizes and shapes (including clamshell housing structures). The keypad may include a mode selection key, or other hardware or software for switching between text entry and telephony entry.

Figure 17:
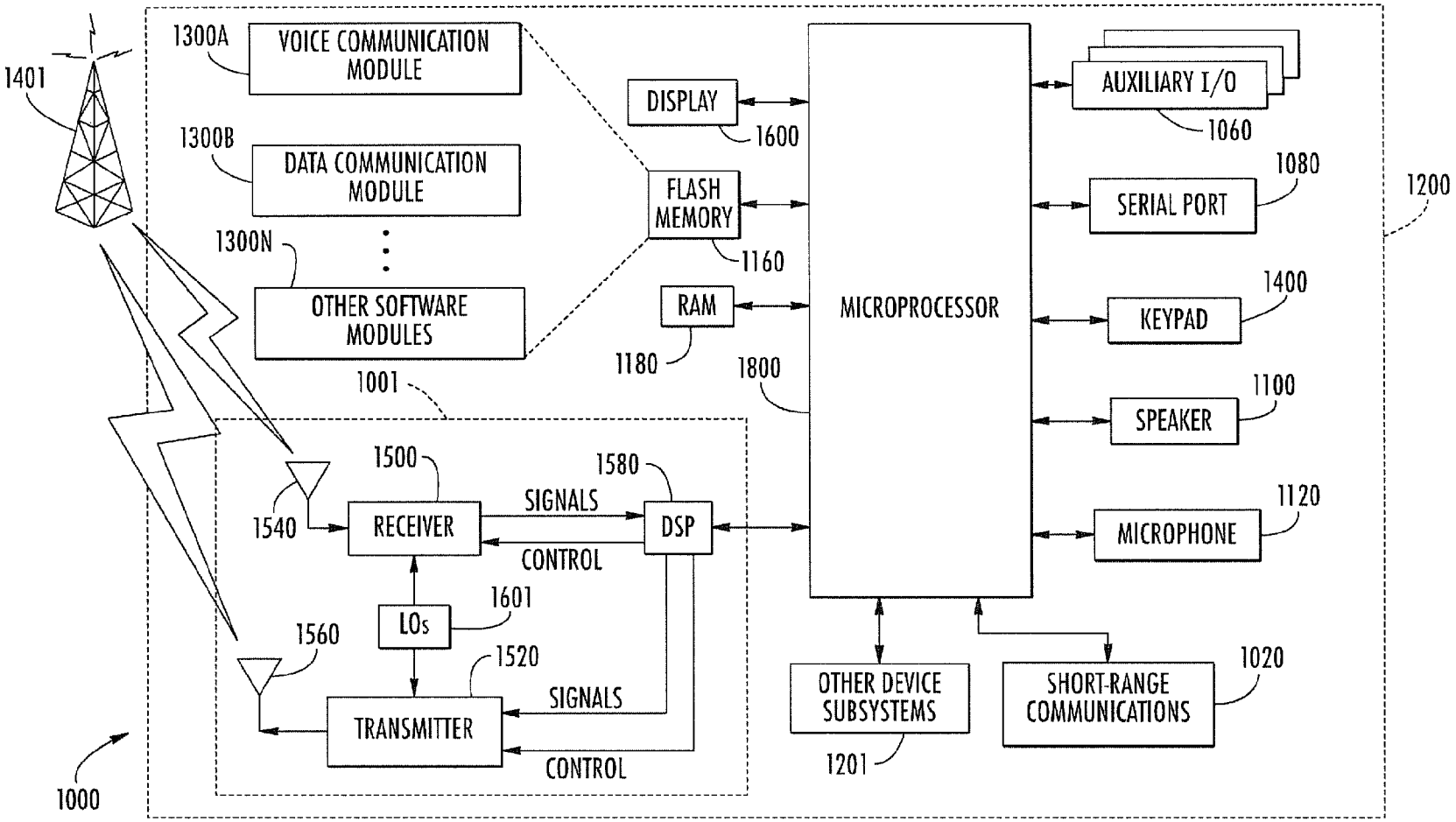
FIG. 17 is a schematic block diagram illustrating in more detail components that may be included in the mobile wireless communications device of FIG. 1.

In addition to the processing device 1800, other parts of the mobile device 1000 are shown schematically in FIG. 17. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 may comprise a two-way RF communications device having data and, optionally, voice communications capabilities. In addition, the mobile device 1000 may have the capability to communicate with other computer systems via the Internet.

Operating system software executed by the processing device 1800 is stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3GPP, UMTS, 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore typically involves use of a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device may also be used to compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, a Bluetooth™ communications module to provide for communication with similarly-enabled systems and devices, or a near field communications (NFC) sensor for communicating with a NFC device or NFC tag via NFC communications.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. A mobile wireless communications device comprising:
a housing;
a circuit board carried by said housing;
wireless communications circuitry carried by said circuit board; and
an antenna assembly carried by said housing and coupled to said wireless communications circuitry, said antenna assembly comprising
an electrically conductive base having a rectangular shape with opposing first and second ends and opposing first and second sides extending between the first and second ends,
said electrically conductive base having a closed elongate slot with opposing closed ends, the closed elongate slot extending within a medial portion of said electrically conductive base and being contained within the opposing first and second ends and the opposing first and second sides, the closed elongate slot being centered between the first and second sides of said electrically conductive base, and
an electrically conductive feed arm extending outwardly from the first side of said electrically conductive base adjacent the first end thereof,
said electrically conductive feed arm having
a distal end with first and second antenna feeds defined thereon, and
a slot therein extending through a medial portion between said first and second antenna feeds.

2. The mobile wireless communications device of claim 1 wherein said antenna assembly comprises a flexible substrate mounting said electrically conductive base and said electrically conductive feed arm.

3. The mobile wireless communications device of claim 2 wherein said flexible substrate comprises:
a planar base mounting portion spaced from said circuit board and mounting said electrically conductive base; and
an arm mounting portion extending downwardly from said planar base mounting portion and mounting said electrically conductive feed arm.

4. The mobile wireless communications device of claim 1 wherein the closed elongate slot is longitudinally offset from the first end and toward the second end of said electrically conductive base.

5. The mobile wireless communications device of claim 1 wherein the closed elongate slot has a rectangular shape.

6. The mobile wireless communications device of claim 1 wherein the closed elongate slot has a width less than a third of a width of said electrically conductive base.

7. The mobile wireless communications device of claim 1 wherein the closed elongate slot has a length greater than half a length of said electrically conductive base.

8. The mobile wireless communications device of claim 1 wherein the closed elongate slot has a length greater than a corresponding length of said electrically conductive feed arm.

9. The mobile wireless communications device according to claim 1 wherein said antenna assembly is operable in a plurality of frequency bands.

10. An antenna assembly for a mobile wireless communications device comprising a housing, a circuit board carried by said housing, and wireless communications circuitry carried by said circuit board, the antenna assembly to be coupled to the wireless communications circuitry and comprising:
an electrically conductive base having a rectangular shape with opposing first and second ends and opposing first and second sides extending between the first and second ends;
said electrically conductive base having a closed elongate slot with opposing closed ends, the closed elongate slot extending within a medial portion of said electrically conductive base and being contained within the opposing first and second ends and the opposing first and second sides, the closed elongate slot being centered between the first and second sides of said electrically conductive base; and an electrically conductive feed arm extending outwardly from the first side of said electrically conductive base adjacent the first end thereof;

said electrically conductive feed arm having a distal end with first and second antenna feeds defined thereon, and a slot therein extending through a medial portion between said first and second antenna feeds.

11. The antenna assembly of claim 10 further comprising a flexible substrate mounting said electrically conductive base and said electrically conductive feed arm.

12. The antenna assembly of claim 11 wherein said flexible substrate comprises:

a planar base mounting portion spaced from the circuit board and mounting said electrically conductive base; and an arm mounting portion extending downwardly from said planar base mounting portion and mounting said electrically conductive feed arm.

13. The antenna assembly of claim 10 wherein the closed elongate slot has a rectangular shape.

14. The antenna assembly of claim 10 wherein the closed elongate slot has a width less than a third of a width of said electrically conductive base.

15. A method of making an antenna assembly for a mobile wireless communications device comprising a housing, a circuit board carried by the housing, and wireless communications circuitry carried by the circuit board, the method comprising:

forming an electrically conductive base having a rectangular shape with opposing first and second ends and opposing first and second sides extending between the first and second ends, the electrically conductive base being formed to have a closed elongate slot with opposing closed ends, the closed elongate slot extending within a medial portion of the electrically conductive base and being contained within the opposing first and second ends and the opposing first and second sides, the closed elongate slot being centered between the first and second sides of the electrically conductive base; and forming an electrically conductive feed arm extending outwardly from the first side of the electrically conductive base adjacent the first end thereof, the electrically conductive feed arm being formed to have a distal end with first and second antenna feeds defined thereon, and a slot therein extending through a medial portion between the first and second antenna feeds.

16. The method of claim 15 wherein the closed elongate slot is formed to be longitudinally offset from the first end and toward the second end of the electrically conductive base.

17. The method of claim 15 wherein the closed elongate slot is formed to have a rectangular shape.

18. The method of claim 15 wherein the closed elongate slot is formed to have a width less than a third of a width of the electrically conductive base.

19. The method of claim 15 wherein the closed elongate slot is formed to have a length greater than half a length of the electrically conductive base.

20. The method of claim 15 wherein the closed elongate slot is formed to have a length greater than a corresponding length of the electrically conductive feed arm.

* * * * *